US006731051B2

(12) United States Patent
Oetken et al.

(10) Patent No.: US 6,731,051 B2
(45) Date of Patent: May 4, 2004

(54) BLUE INCANDESCENT APPLIANCE LAMP

(75) Inventors: James E. Oetken, Winchester, KY (US); Cynthia J. Labant, St. Marys, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/127,313

(22) Filed: Apr. 22, 2002

(65) Prior Publication Data

US 2003/0197455 A1 Oct. 23, 2003

(51) Int. Cl.[7] ..... H01J 5/16

(52) U.S. Cl. ..... 313/112; 313/635; 313/486; 313/18.01; 252/301.6; 252/301.4; 252/301.5

(58) Field of Search ..... 313/635, 112, 313/486, 18.01; 252/301.6, 301.4; 423/301.5, 339

(56) References Cited

U.S. PATENT DOCUMENTS 4,038,098 A * 7/1977 Wason ..... 106/492
4,097,783 A * 6/1978 Hathaway ..... 315/323
RE31,543 E * 3/1984 Bank et al. ..... 523/435
5,482,907 A * 1/1996 Tuan et al. ..... 501/120
5,541,248 A * 7/1996 Haluska et al. ..... 524/420
5,561,203 A * 10/1996 Strong et al. ..... 525/477
5,635,123 A * 6/1997 Riebel et al. ..... 264/125
5,744,900 A * 4/1998 Labant ..... 313/112
5,969,476 A * 10/1999 Labant ..... 313/635
6,017,640 A * 1/2000 Muthiah et al. ..... 428/514
6,054,502 A * 4/2000 Friedlander et al. ..... 522/96
6,426,373 B1 * 7/2002 Stange et al. ..... 523/116
6,555,022 B2 * 4/2003 Hampden-Smith et al. ..... 252/301.4 R
6,570,302 B1 * 5/2003 Boonekamp et al. ..... 313/113

* cited by examiner

*Primary Examiner*—Vip Patel
*Assistant Examiner*—Holly Harper
(74) *Attorney, Agent, or Firm*—William F. Meyer

(57) ABSTRACT

An electric lamp (10) which emits a blue color when energized and which comprises a light transmissive envelope (12) enclosing an electric light source (16) within, said envelope (12) having a surface (11) on which is a coating comprising sulfate precipitated silica, aluminum silicate pigment, and cobalt blue aluminate spinel. The lamp is useful in appliances such as refrigerators.

3 Claims, 2 Drawing Sheets

BLUE INCANDESCENT APPLIANCE LAMP

TECHNICAL FIELD

This invention relates to incandescent lamps and more particularly to low wattage lamps used as appliance lamps. Still more particularly, it relates to lamps useful in refrigerators.

BACKGROUND ART

Home appliances such as refrigerators and conventional ovens often are provided with a low wattage lamp to illuminate the interior of the appliance. These lamps, usually in an A15 envelope and usually of about 40 watts, have conventionally been acid etched on the interior surface to diffuse the light and eliminate the shadowing effect that might be caused by a clear bulb. Recently, environmental concerns have arisen because of the acid involved in the etching process.

DISCLOSURE OF INVENTION

It is, therefore, an object of the invention to obviate the disadvantages of the prior art.

It is another object of the invention to enhance appliance lamps.

It is yet another object of the invention to provide an appliance lamp that has an environmentally safe coating on the interior surface allowing the spent Lamp to be landfilled.

These objects are accomplished, in one aspect of the invention, by the provision of an electric lamp which emits a blue color when energized and which comprises a light transmissive envelope enclosing an electric light source within, said envelope having a surface on which is a coating comprising sulfate precipitated silica, aluminum silicate pigment, and cobalt blue aluminate spinel The soft blue color provides a higher color temperature and enhances the lighting appearance of the appliance to the user. The internally powder coated uses an environmentally safe formula that enables the spent lamp to be landfilled.

BEST MODE FOR CARRYING OUT THE INVENTION

Figure 1:
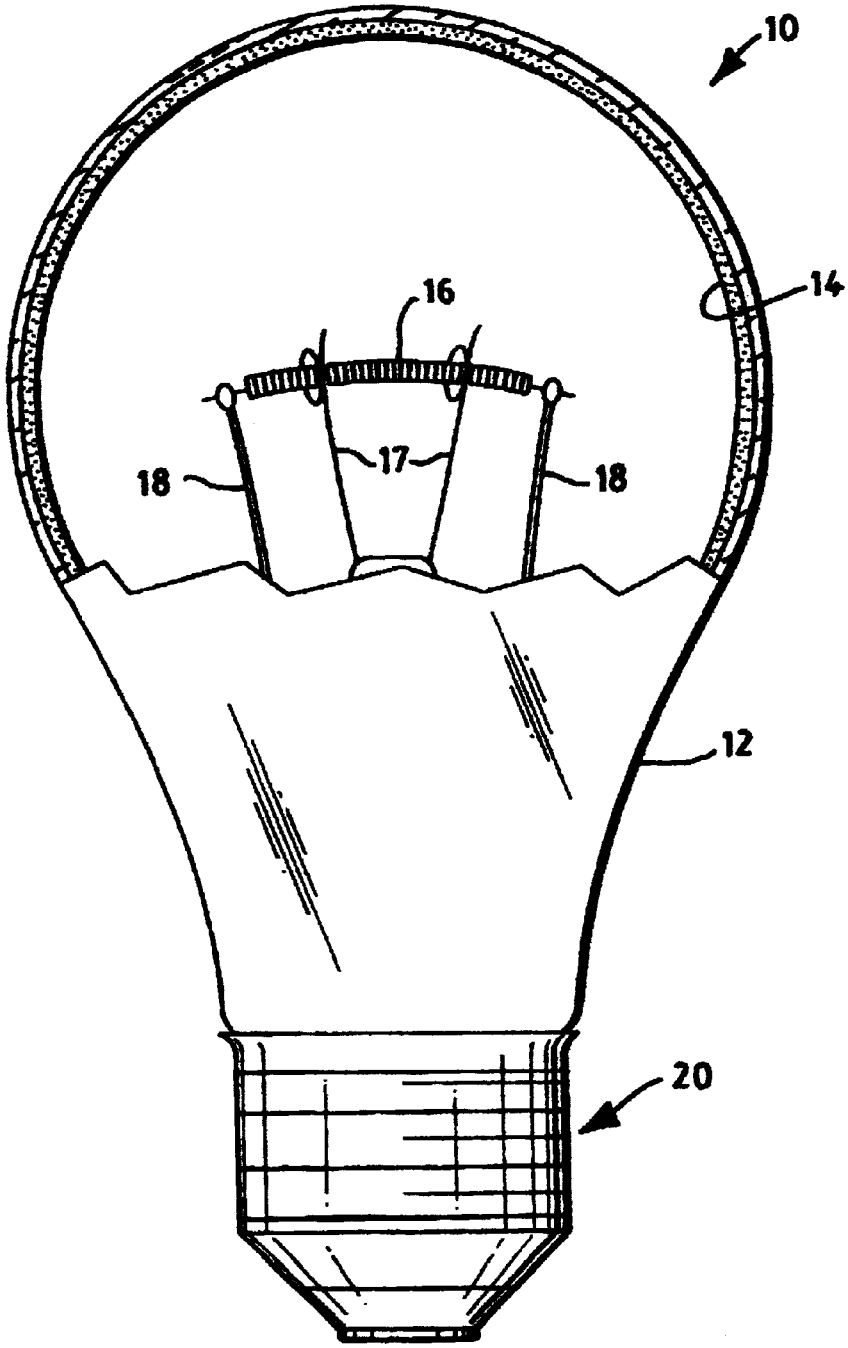
FIG. 1 is a diagrammatic view, partially in section, illustrating an embodiment of the invention.
Figure 2:
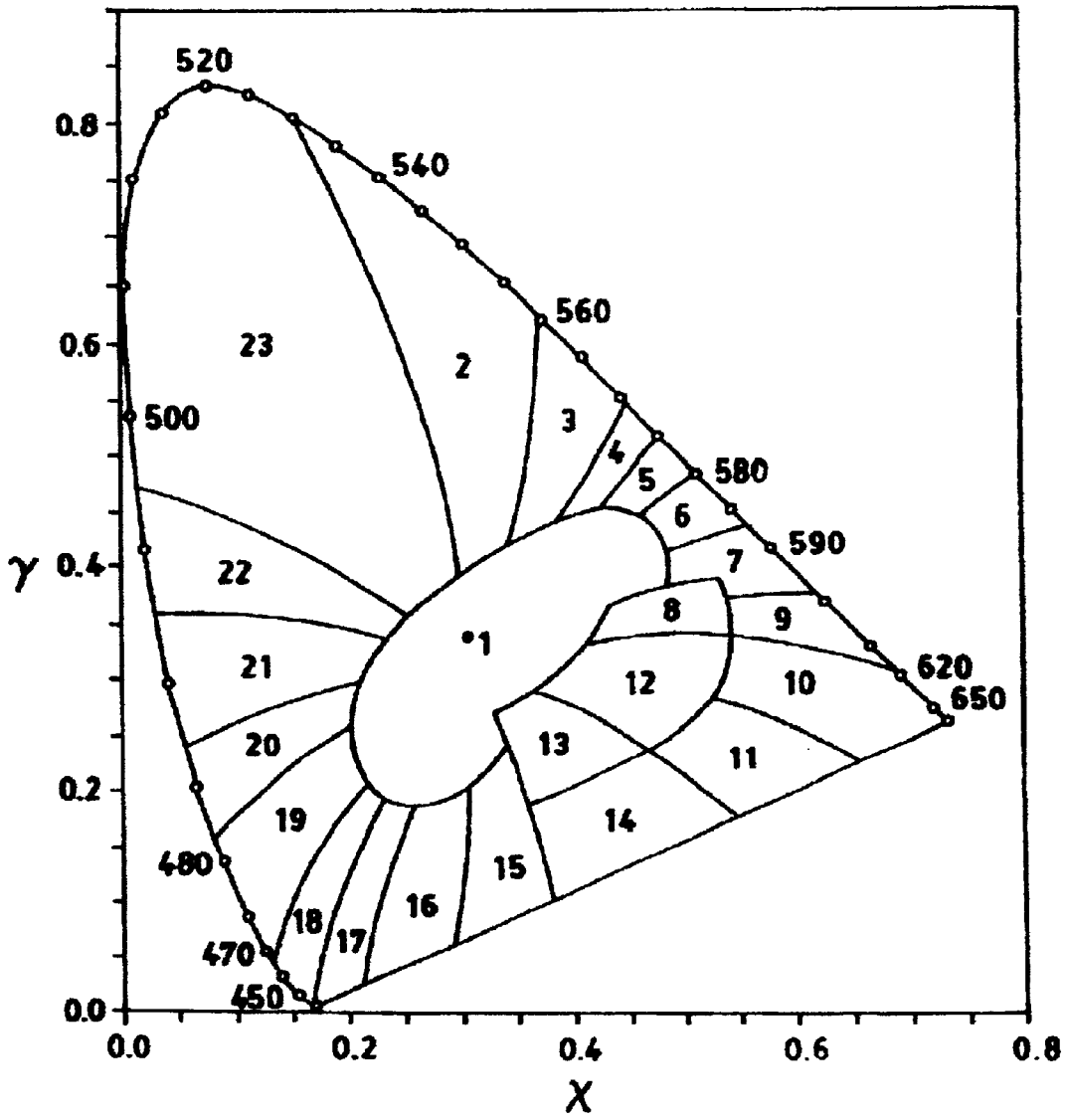
FIG. 2 is a representation of the standard ICI color diagram.

For a better understanding of the present invention, together with other and further objects, advantages and capabilities thereof, reference is made to the following disclosure and appended claims in conjunction with the above-described drawing.

Referring now to the drawing with greater particularity, there is shown in the figure an A-line incandescent type lamp 10 having on an interior surface 11 of its light transmissive glass envelope 12 a coating 14 in accordance with an aspect of the invention. A filament 16 of, for example, tungsten, is electrically connected to and supported by lead-ins 18 which extend through the seal of the lamp and are attached, as is known, to a screw base 20. Other forms of bases can be employed, such as the type known in the art as bayonet bases. Additionally, other support for the filament 16 can be provided by support wires 17.

The interior surface 11 of envelope 12 is coated with a powder coating 14. Coating 14 is applied electrostatically by means well know to those skilled in the art, see, for example U.S. Pat. Nos. 2,995,463; 3,125,457; 3,320,460 and 4,633,127.

The coating 14 of the present invention comprises sulfite precipitated silica, aluminum silicate pigment, and cobalt blue aluminate spinel.

The lamp, when energized has color coordinates of X=0.4591 to 0.4629 and Y=0.4098 to 0.4111 on a standard ICI diagram and a color temperature of 2685 K The ICI diagram (International Commission on Illumination) is also known especially in England and the European continent as the CIE (Commission Internationale d'Eclairage) system or diagram These lamps have an average light output of 289 lumens and average chromaticity coordinates of X=0.4608 and Y=0.4104.

The applied powder was formulated by combining, in wt. %, 46% PPG Lovel Synthetic Sulfate Precipitated Silica; 46% Burgess 50 Aluium Silicate Pigment and from 6.5 to 8% Shepard Cobalt Aluminate Blue Spinel Industrial Pigment (CoAlO).

While there have been shown and described what are at present considered to be the preferred embodiments of the invention, it will be apparent to those skilled in the art that various changes and modification can be made herein without departing from the scope of the invention as defined by the appended claims.

What is claimed is:

1. An electric lamp which emits a blue color when energized and which comprises a light transmissive envelope enclosing an electric light source within, said envelope having a surface on which is a coating comprising sulfate precipitated silica, aluminum silicate pigment, and cobalt blue aluminate spinel.

2. The lamp of claim 1 wherein said sulfate precipitated silica comprises about 46 wt. % of said coating; said aluminum silicate pigment comprises about 46 wt. % of said coating and said cobalt blue aluminate spinel comprises about 6.5 to 8 wt. % of said coating.

3. The lamp of claim 1 wherein said blue color emitted when said lamp is energized has coordinates of X=0.4591 to 0.4629 and Y=0.4098 to 0.4111 on a standard ICI diagram.

* * * * *